United States Patent [19]

Kemble

[11] Patent Number: 4,546,907

[45] Date of Patent: Oct. 15, 1985

[54] METHOD AND SYSTEM FOR REMOVAL OF RESIDUAL MATERIAL FROM TORPEDO CARS

[76] Inventor: Mern S. Kemble, 130 Entrance Dr., New Kensington, Pa. 15068

[21] Appl. No.: 469,030

[22] Filed: Feb. 23, 1983

[51] Int. Cl.[4] ..... B22D 23/00; B22D 41/04

[52] U.S. Cl. ..... 222/590; 222/596; 222/604

[58] Field of Search ..... 222/590, 591, 596, 604, 222/386, 333, 626, 606, 607, 594; 414/509, 517; 266/155

[56] References Cited

U.S. PATENT DOCUMENTS 3,467,284 9/1969 Koncsics et al. ..... 222/604
4,220,280 9/1980 Trott et al. ..... 222/626 X
4,415,104 11/1983 Boudreault ..... 222/626 X

FOREIGN PATENT DOCUMENTS 486025 12/1927 Fed. Rep. of Germany ..... 222/591
56153 3/1982 Japan ..... 222/604

*Primary Examiner*—F. J. Bartuska
*Attorney, Agent, or Firm*—Jon M. Lewis

[57] ABSTRACT

The removal of residual material from torpedo cars or the like is facilitated with use of apparatus including a generally open topped and a generally flat bottom heat resistant receiving container that permits molten pig iron to be removed from torpedo cars and allows it to go to a ladle while retaining slag to prevent the slag from being transferred to the ladle. Use of the invention permits the elimination of dekishing operations.

8 Claims, 3 Drawing Figures

METHOD AND SYSTEM FOR REMOVAL OF RESIDUAL MATERIAL FROM TORPEDO CARS

BACKGROUND OF THE INVENTION

FIELD OF INVENTION

This invention relates to the removal of residual materials such as slag and iron from torpedo cars and the like. Torpedo cars are commonly employed to transport molten pig iron from the blast furnace to steelmaking facilitates such as open hearth furnaces, basic oxygen furnaces, electric furnaces and the like. Typically the contents of torpedo cars are emptied into a refractory lined transfer ladle which is then used to transfer the iron into the steelmaking furnace for refining into steel.

Pig iron normally contains sulphur in amounts that are greater than can be tolerated in the final steel product. Hence, such impurity must be removed during refining into steel. This problem has been magnified due to the increased use of relatively high sulphur containing coke in the blast furnace as well as due to certain operating practices that, while yielding higher productivity have also resulted in higher sulphur contents than obtained in the past. A penalty for such blast furnace practices is encountered during steelmaking because sulphur removal is extremely difficult and time consuming. To overcome such penalty, steel producers have resorted to the use of sulphur removal operations prior to charging of the pig iron into the steelmaking vessel. These desulphurization operations are conducted in the torpedo car at a desulphurization station located between the blast furnace and steelmaking facility. Typically several types of desulphurization operations may be conducted. The usual practice has been to utilize a rotatable angled heat resistant lance to inject desulphurization materials that are conveyed by an inert gas beneath the surface of the molten pig iron. Calcium carbide is utilized in some processes and a lime-magnesium mixture is utilized in other processes of commercial interest. In any event, in either process, sulphur reacts with the injected material and the reaction product floats to the top of the iron bath and is collected in a slag which covers and insulates the top of the bath. In view of the beneficial insulating function, a slag is always utilized to cover the bath. Thus, a slag is present whether or not a desulphurization process is conducted. However, higher slag volumes are necessarily involved if the pig iron has been desulphurized.

Upon arrival at the steelmaking facility, the contents of the torpedo car are transferred to a transfer ladle for charging into the steelmaking furnace. To effect removal of the contents from the torpedo car, the car is rotated so that the pouring hole or opening in the top of this torpedo-shaped refractory-lined railroad car is positioned in such a manner that the metal and slag flow from the car into the ladle. Prior to this invention, the torpedo cars could not be completely emptied of their contents for various reasons. Typically on the order of 5% of the contents would remain in the car. When attempts were made to remove the final 5%, metal would strike the top of the ladle thereby corroding the rim of the ladle. Striking the rim also causes a safety problem due to spraying of the debris. Such spraying commonly could extend to the weight scales commonly weigh scales are located at the pour station, thereby causing damage to the scales and other equipment.

Failure to remove all of the contents of the torpedo car causes a solidified build-up in the car and, in any event, involves a lowered transport capacity for the vessel. Additionally, slag remaining in the vessel normally has a high sulphur content and thereby serves to contaminate the next load of pig iron from the blast furnace.

To overcome the above mentioned problems associated with lack of complete removal of the contents of the torpedo car, the cars have been emptied at a kish station. Dekishing of the car involves removal of the iron and/or slag remaining in the car. Typically the car is rotated and rerotated until the residual slag and iron materials are essentially completely removed. The iron and slag is normally collected in a pit or on the ground. The accumulated material is then broken and hauled away. Dekishing is a dirty and relatively dangerous operation due to the possibility of an explosion in the event of moisture present in the pit or on the ground. Hence, the elimination of such operation is a highly advantageous objective from the standpoints of safety and environmental control. This invention eliminates the need for dekishing by providing a unique and high advantageous technique whereby virtually the entire contents of the torpedo car can be safely and efficiently transferred into the transfer ladle in the steelmaking facility.

SUMMARY OF THE INVENTION

The invention generally comprises an apparatus for facilitating the transfer of molten pig iron and slag from a torpedo car to a ladle. The apparatus includes a container having a generally flat heat resistant bottom surface upon which the pig iron and slag is poured from the torpedo car, the container has a generally open top. The container further includes at least three raised sides for containing the poured pig iron and slag and an at least partially open side for the poured contents to be removed into a transfer ladle. One of the raised sides is movable along the flat surface so as to be able to push the poured pig iron and slag along the bottom surface and to cause exit thereby through the open side. Also included are means for causing the raised side to move along the flat surface and then to return to its original position.

The invention also includes a method for transferring molten pig iron and slag from a torpedo car into a ladle. The method includes pouring molten pig iron and slag onto a generally flat, heat resistant bottom surface of a container having three raised sides and an open side, and an open top; the open side being positioned proximate to a ladle and moving one of said raised sides against said molten pig iron and slag contained upon the flat surface so as to cause said pig iron and slag to exit from the container and pass into the ladle.

DETAILED DESCRIPTION OF THE INVENTION

Figure 1:
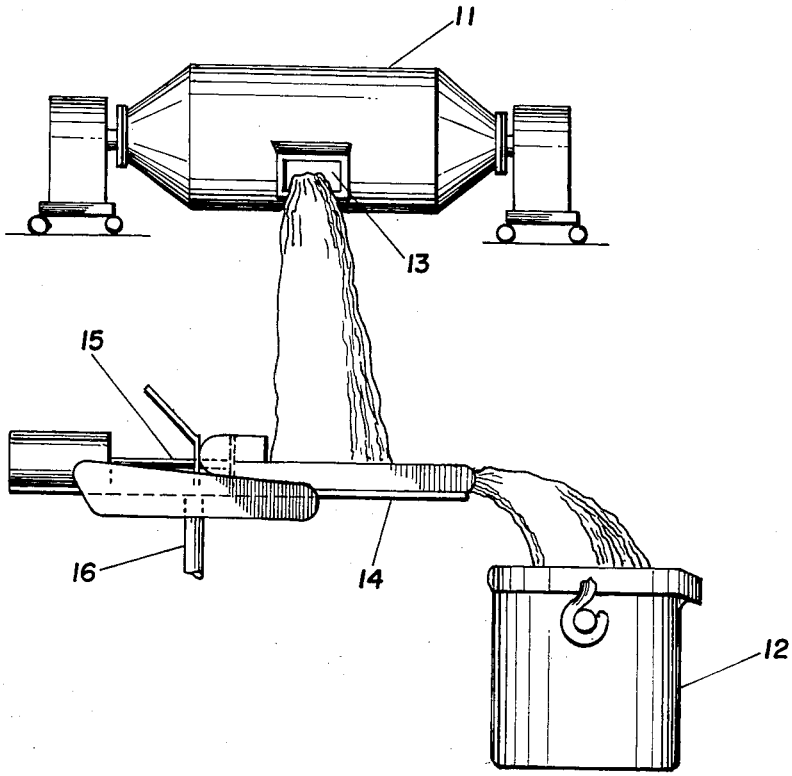
FIG. 1 is a schematic depiction of the apparatus of the invention being employed to perform the method of the invention.

FIG. 1 is a schematic representation of the use of the apparatus of the invention in combination with torpedo car 11 and transfer ladle 12. As may be seen, torpedo car 11 has been rotated about its longitudinal axis so as to position opening 13 over container 14 so that molten pig iron and slag is poured from the opening into container 14. Once container 14 has received the molten pig iron and slag, push member 15 is activated so as to push the pig iron and slag from container 14 through its open end. The pig iron and slag then fall into and are collected in transfer ladle 12. Following completion of the push removal operation, member 15 is returned to its original position and is ready for another push removal cycle. Jack 16 may be used to curtail the angle of inclination of the receiving portion of the apparatus and thereby provide further flexibility of operation.

Figure 2:
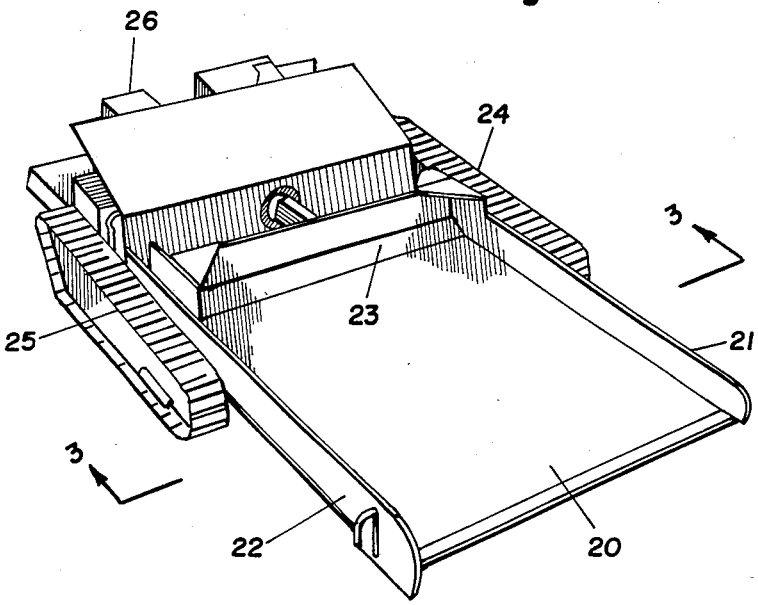
FIG. 2 is a perspective view of the apparatus of the invention.
Figure 3:
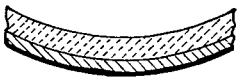
FIG. 3 is a sectional view of the apparatus of the invention taken along lines 3—3 of FIG. 2.

FIG. 2 is a perspective drawing of the container apparatus of the invention. The container comprises generally flat bottom 20, side members 21 and 22, push side member 23. The container is open sided on the side opposite to member 23 and is also open topped. The container is of sufficient size and shape so as to be capable of receiving material dislodged during the period involving removal of the final 5% or so of the material from the torpedo car without creation of undue splashing. Preferably the apparatus is only used during such period. This procedure effectively solves the long standing problems in the art that were mentioned previously. The invention may be used in such manner due to its easily movable nature. Mobility may be obtained, for example, with use of continuous tracks 24 and 25. Push side member 23 function to contain the poured material and then to push such material from the opposite end of the container. The pushing operations may be accomplished through use of this member as a room. Hydraulic means 26 may be used to move member 23. As such means are conventional, no detail is provided in the drawing. The bottom portion of the container may be constructed of steel and should be lined with a commonly available refractory material such as refractory brick to withstand the molten pig iron and slag without backlog. Such feature is illustrated in FIG. 3 which is a cross-section of the container along line 3—3 of FIG. 2. This view also illustrates a preferable feature of the invention which involves the profile of the container. By tapering toward the center, the stream may be directed to the center of the container and more easily expelled. The plate may be preferably constructed at an angle of about 2 degrees to 7 degrees from horizontal to facilitate removal of the material from the container. Jack 16 in FIG. 1 may be used to change the angle.

I claim:

1. System for facilitating transfer of molten pig iron and slag from a torpedo car to a ladle, comprising:

a. a torpedo car for containing molten pig iron and slag;

b. a ladle for holding molten pig iron;

c. a container having a generally flat bottom surface made of a heat resistant material upon which said pig iron and slag is poured from said torpedo car and an open top, said container having at least three raised sides to contain poured pig iron and slag and an at least partially open side for the poured pig iron and slag to be removed into said ladle, one of said raised sides being movable along said flat bottom surface so as to be able to push said pig iron and slag and to cause exit thereby through said open side; and d. means for causing said movable raised side to move along said flat bottom surface and to return to its original position.

2. The system of claim 1, wherein: said flat bottom surface is lined with a refractory material.

3. The system of claim 1 which further includes:

means for positioning said system at a desired location proximate to said torpedo car and ladle.

4. The system of claim 1, wherein:

said means for causing movement of said movable raised side are hydraulic.

5. The system of claim 1, wherein:

said flat bottom surface is at an angle from about 2 to 7 degrees from horizontal.

6. The system of claim 5, further including:

jack means to alter said angle.

7. The system of claim 1 further comprising:

a container having a generally flat heat resistant bottom surface, said bottom surface being tapered towards its center.

8. A method for transferring molten and slag from a torpedo car into a ladle, comprising:

a. pouring molten pig iron and slag from the torpedo car onto a generally flat, heat resistant bottom surface of a container having three raised sides, an open side, an open top, said open side being positioned proximate to a ladle;

b. moving one of said raised sides against said molten pig iron and slag contained on said flat bottom surface so as to cause said pig iron and slag to exit from said container and pass into said ladle.

* * * * *